US008550583B2

(12) United States Patent
Sai

(10) Patent No.: US 8,550,583 B2
(45) Date of Patent: Oct. 8, 2013

(54) IMAGE FORMING APPARATUS, METHOD OF CONTROLLING CARRIAGE TRAVEL, AND COMPUTER-READABLE STORAGE MEDIUM

(75) Inventor: Noriyuki Sai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 297 days.

(21) Appl. No.: 13/027,924

(22) Filed: Feb. 15, 2011

(65) Prior Publication Data

US 2011/0205271 A1 Aug. 25, 2011

(30) Foreign Application Priority Data

Feb. 22, 2010 (JP) ..... 2010-036544

(51) Int. Cl.
*B41J 29/38* (2006.01)

(52) U.S. Cl.
USPC ..... 347/9; 347/5

(58) Field of Classification Search
USPC ..... 347/9, 5, 20, 84; 355/53; 409/178
See application file for complete search history.

(56) References Cited

U.S. PATENT DOCUMENTS

| | | | | |
|---|---|---|---|---|
| 2005/0151768 | A1* | 7/2005 | Merz et al. | 347/9 |
| 2005/0206676 | A1 | 9/2005 | Ishii et al. | |
| 2006/0159539 | A1* | 7/2006 | Boyl-Davis et al. | 409/178 |
| 2009/0268178 | A1* | 10/2009 | Shibazaki | 355/53 |

FOREIGN PATENT DOCUMENTS

| | | | |
|---|---|---|---|
| JP | 03-256772 | | 11/1991 |
| JP | 2001-121721 | | 5/2001 |
| JP | 2001-138499 | | 5/2001 |
| JP | 2001138499 | A * | 5/2001 |
| JP | 2003-237165 | | 8/2003 |
| JP | 2003-341168 | | 12/2003 |
| JP | 2005-081673 | | 3/2005 |
| JP | 2005-169715 | | 6/2005 |
| JP | 2005-212160 | | 8/2005 |
| JP | 2005-297514 | | 10/2005 |
| JP | 2007-152899 | | 6/2007 |

* cited by examiner

*Primary Examiner* — Manish S Shah
*Assistant Examiner* — Yaovi Ameh
(74) *Attorney, Agent, or Firm* — Ipusa, PLLC

(57) ABSTRACT

An image forming apparatus includes a carriage configured to travel with a recording head configured to eject liquid droplets being mounted thereon; a first encoder including a first encoder scale placed along a traveling direction of the carriage and a first encoder sensor configured to read the first encoder scale; an antiphase member configured to travel in opposite phase from the carriage; a second encoder including a second encoder scale placed along a traveling direction of the antiphase member and a second encoder sensor configured to read the second encoder scale; and a control part configured to control the travel of the carriage in accordance with the detection result of the first encoder and the detection result of the second encoder.

15 Claims, 15 Drawing Sheets

IMAGE FORMING APPARATUS, METHOD OF CONTROLLING CARRIAGE TRAVEL, AND COMPUTER-READABLE STORAGE MEDIUM

CROSS-REFERENCE TO RELATED APPLICATION

The present application is based upon and claims the benefit of priority of Japanese Patent Application No. 2010-036544, filed on Feb. 22, 2010, the entire contents of which are incorporated herein by reference.

BACKGROUND OF THE INVENTION

1. Field of the Invention

The present invention relates generally to image forming apparatuses, methods of controlling carriage travel in image forming apparatuses, and non-transitory computer-readable storage media storing a program for causing a computer to execute such methods, and more particularly to an image forming apparatus including a recording head configured to eject liquid droplets, a method of controlling carriage travel in the image forming apparatus, and a non-transitory computer-readable storage medium storing a program for causing a computer to execute such a method.

2. Description of the Related Art

As image forming apparatuses such as printers, facsimile machines, copiers, plotters, and multifunction machines having multiple functions of these apparatuses, those of a liquid ejection recording system using a recording head configured to eject ink droplets, such as inkjet recorders, are known. Image forming apparatuses of this liquid ejection recording system perform image forming (for which "recording" and "printing" may be synonymously used) on conveyed paper by ejecting ink droplets from a recording head onto the paper. These image forming apparatuses include serial image forming apparatuses and line image forming apparatuses. The serial image forming apparatus forms an image by ejecting liquid droplets while moving its recording head in a main scanning direction. The line image forming apparatus forms an image by ejecting liquid droplets without moving its recording head.

In the present invention, an "image forming apparatus" refers to an apparatus configured to form an image on media such as paper, thread, fiber, cloth, leather, metal, plastic, glass, wood, and ceramics by causing ink to land on them. Further, "image forming (image formation)" refers not only to providing media with meaningful images such as characters and figures but also to providing media with meaningless images such as patterns (simply causing liquid droplets to land on media). Further, the term "ink" is used not only for what is called ink but also as a general term for all liquids with which it is possible to perform image forming, such as those called recording liquid, a fixing solution, liquid, and resin. Further, the term "paper," which does not limit material to paper and includes overhead projector (OHP) sheets, cloth, etc., refers to what ink droplets are caused to adhere to, and is used as a general term for what are called a recording medium, recording paper, etc. Further, the term "image" not only refers to planar images but also includes images provided for three-dimensionally formed objects and images formed by shaping solid bodies three-dimensionally.

In serial image forming apparatuses, a linear encoder (position detector) that includes an encoder scale disposed along a main scanning direction of a carriage loaded with liquid ejecting heads and an encoder sensor configured to read the scale (position identifying part) of this encoder scale is provided to detect the position and the speed of the carriage, and the traveling speed of the carriage and the driving of the liquid ejecting heads are controlled based on the detection result.

Conventional linear encoders range from those magnetic to those optical. The magnetic linear encoder has the advantage that its performance is not affected by adhesion of a small amount of dirt on the surface of the linear scale. However, it is difficult to make the magnetic linear encoder higher and finer in resolution and to increase a gap between its linear scale and encoder sensor, and there are the problems of attachment accuracy and treatment of magnetized tools in the magnetic linear encoder. On the other hand, it is relatively easy to increase the gap between the encoder scale and the encoder sensor of the optical linear encoder, and the optical linear encoder is easy to assemble. Therefore, the optical linear encoder is suitable for increasing the resolution.

However, as linear encoders have become higher in resolution with increases in the speed and the accuracy of image forming apparatuses, the scattering of liquid such as ink inside the apparatus, a decrease in output due to adhesion of paper powder, and the influence of erroneous signals have become unignorable problems. For example, ink mist and/or paper powder adheres to an encoder scale and/or an encoder sensor during use over a long period to cause read errors, which causes problems such as a fuzzy recorded image due to carriage mispositioning and the stoppage of a machine due to occurrence of an error.

Therefore, image forming apparatuses are known that include a unit to clean the encoder scale. (See, for example, Patent Documents 1 through 3 listed below.)

On the other hand, in the serial image forming apparatus, vibrations are induced in the apparatus body by the reciprocating motion of a carriage loaded with recording heads. In particular, an increase in the carriage speed for increasing printing speed has caused the carriage to accelerate or decelerate suddenly at the time of performing scanning in a main scanning direction, which has increased the vibrations of the apparatus body. Further, in multifunction machines including an image reader (scanner), the above-described vibrations of the apparatus body caused on the side of an image forming part cause vibrations to the scanning by the scanner, thereby causing degradation of a read image.

Therefore, attempts have been made to prevent carriage vibrations. For example, it is known to reduce the vibrations of a carriage by attaching a vibration damping member having substantially the same mass as the carriage to a timing belt for moving the carriage and moving the carriage and the vibration damping member in opposite directions. (See, for example, Patent Documents 4 and 5 listed below.) In this case, it is also known to provide two carriages loaded with respective recording heads and control the movement of each carriage based on the result of reading a common encoder sheet. (See, for example, Patent Document 6 listed below.)

[Patent Document 1] Japanese Laid-Open Patent Application No. 2001-121721

[Patent Document 2] Japanese Laid-Open Patent Application No. 2005-169715

[Patent Document 3] Japanese Laid-Open Patent Application No. 2005-297514

[Patent Document 4] Japanese Laid-Open Patent Application No. 2001-138499

[Patent Document 5] Japanese Laid-Open Patent Application No. 2007-152899

[Patent Document 6] Japanese Laid-Open Patent Application No. 2003-341168

SUMMARY OF THE INVENTION

According to one aspect of the present invention, an image forming apparatus includes a carriage configured to travel with a recording head configured to eject liquid droplets being mounted thereon; a first encoder including a first encoder scale placed along a traveling direction of the carriage and a first encoder sensor configured to read the first encoder scale; an antiphase member configured to travel in opposite phase from the carriage; a second encoder including a second encoder scale placed along a traveling direction of the antiphase member and a second encoder sensor configured to read the second encoder scale; and a control part configured to control a travel of the carriage in accordance with a detection result of the first encoder and a detection result of the second encoder.

According to one aspect of the present invention, a method of controlling carriage travel in an image forming apparatus includes reading, with a first encoder sensor of a first encoder, a first encoder scale thereof placed along a traveling direction of a carriage having a recording head configured to eject liquid droplets mounted thereon; reading, with a second encoder sensor of a second encoder, a second encoder scale thereof placed along a traveling direction of an antiphase member configured to travel in opposite phase from the carriage; and controlling a travel of the carriage in accordance with a detection result of the first encoder based on said reading the first encoder scale and a detection result of the second encoder based on said reading the second encoder scale.

According to one aspect of the present invention, a non-transitory computer-readable storage medium stores a program for causing a computer to execute a method of controlling carriage travel in an image forming apparatus, the method including reading, with a first encoder sensor of a first encoder, a first encoder scale thereof placed along a traveling direction of a carriage having a recording head configured to eject liquid droplets mounted thereon; reading, with a second encoder sensor of a second encoder, a second encoder scale thereof placed along a traveling direction of an antiphase member configured to travel in opposite phase from the carriage; and controlling a travel of the carriage in accordance with a detection result of the first encoder based on said reading the first encoder scale and a detection result of the second encoder based on said reading the second encoder scale.

The object and advantages of the embodiments will be realized and attained by means of the elements and combinations particularly pointed out in the claims.

It is to be understood that both the foregoing general description and the following detailed description are exemplary and explanatory and not restrictive of the invention as claimed.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

As described above, attempts have been made to prevent carriage vibrations in the serial image forming apparatus. There is, however, a problem in that this results in a complicated configuration in the arrangement having a cleaning unit to clean the encoder sheet as described above.

According to one aspect of the present invention, malfunction due to contamination of an encoder scale may be reduced with a simple configuration.

A description is given, with reference to the accompanying drawings, of embodiments of the present invention.

Figure 1:
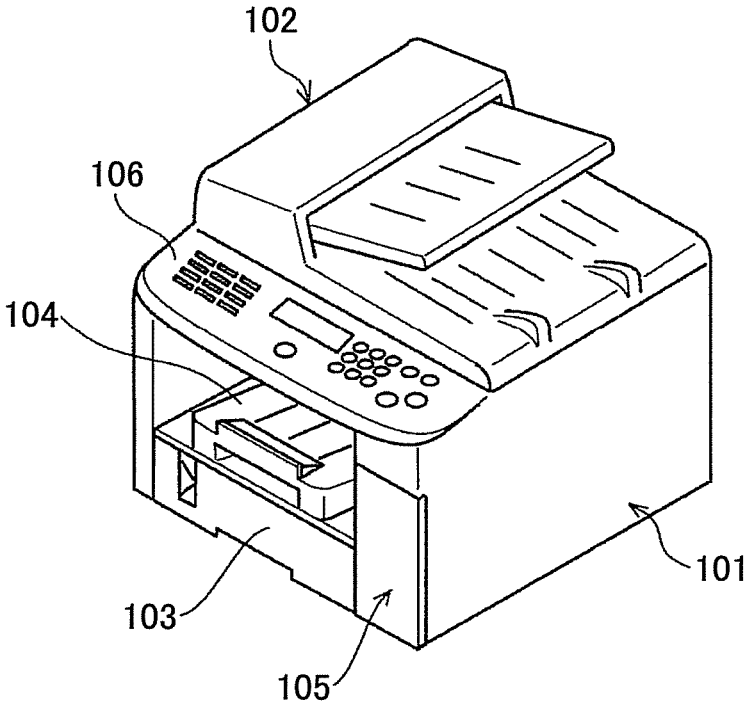
FIG. 1 is a perspective view of an image forming apparatus according to a first embodiment of the present invention.
Figure 2:
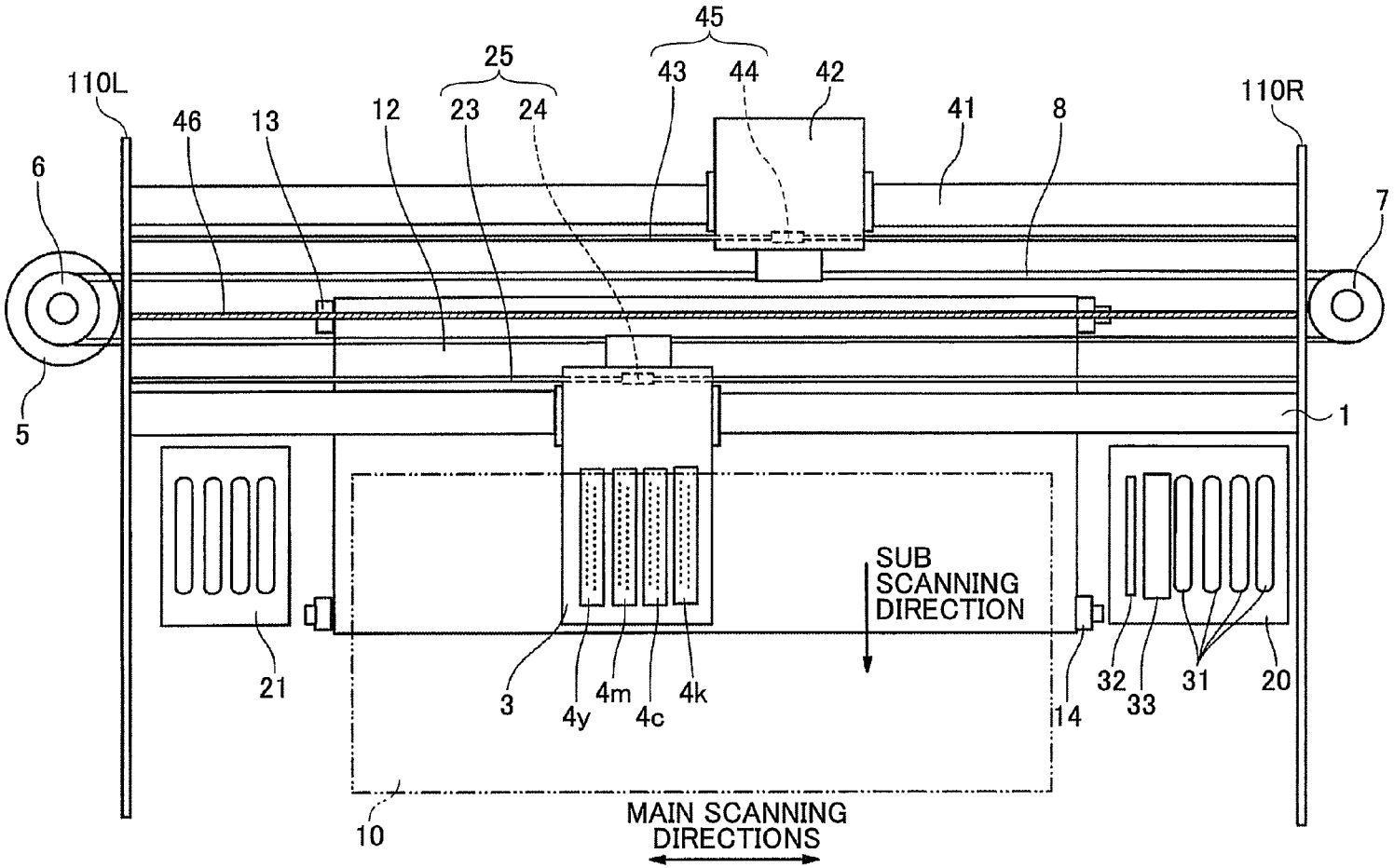
FIG. 2 is a schematic plan view of a mechanical part of the image forming apparatus according to the first embodiment of the present invention.
Figure 3:
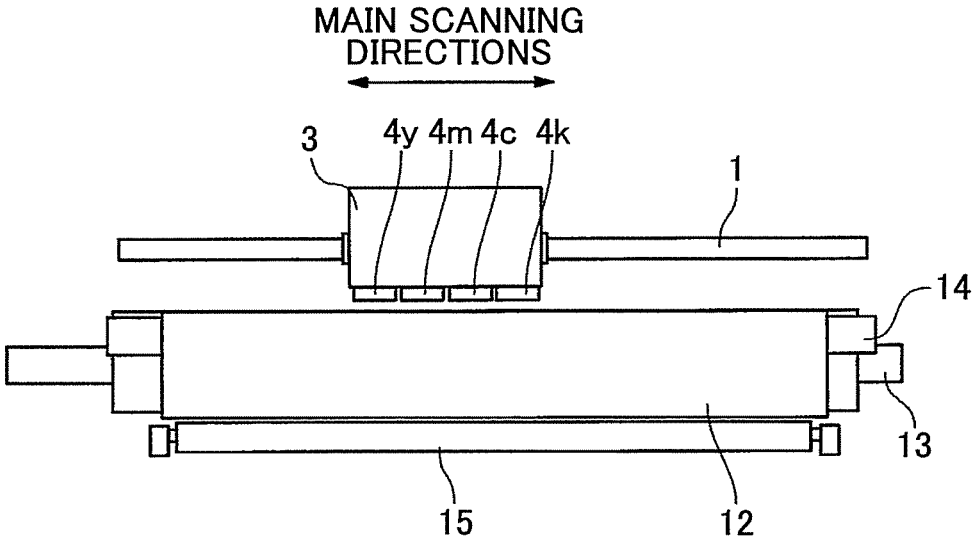
FIG. 3 is a front view of the mechanical part of the image forming apparatus according to the first embodiment of the present invention.

First, an overview is given, with reference to FIG. 1 through FIG. 3, of an inkjet recorder as an image forming apparatus according to a first embodiment of the present invention. FIG. 1 is a perspective view of the image forming apparatus. FIG. 2 is a plan view of a mechanical part of the image forming apparatus. FIG. 3 is a front view of the mechanical part of the image forming apparatus.

Referring to FIG. 1, the image forming apparatus includes an apparatus body 101 configured to perform image forming, an image reading part (scanner part) 102 configured to read an image, a paper feed cassette 103 configured to store paper (paper sheets) to be fed to the mechanical part, a paper output tray 104 configured to store discharged paper on which an image is formed, a cartridge attachment part 105 to which ink cartridges are to be attached, and an operations and display part (operations panel) 106 for inputting various operational signals and displaying information to be displayed. The image reading part 102 is provided on top of the apparatus body 101. The paper feed cassette 103 is detachably (and reattachably) attached to the apparatus body 101. The paper output tray 104 is attached to the upper side of the paper feed cassette 103. The cartridge attachment part 105 is on the front side of the apparatus body 1.

Further, as illustrated in FIG. 2 and FIG. 3, inside the apparatus body 101, the carriage 3 is slidably held with a main guide rod 1 and a sub guide member (not graphically illustrated) provided laterally between a right side plate 1108 and a left side plate 110L, and is caused to move and scan in main scanning directions by a main scanning motor 5 via a timing belt 8 stretched between a drive pulley 6 and a driven pulley 7.

Multiple recording heads 4*y*, 4*m*, 4*c*, and 4*k* formed of respective liquid ejecting heads for ejecting color ink droplets of yellow (Y), magenta (M), cyan (C), and black (K) are attached to the carriage 3 with their respective nozzles arranged in arrays (nozzle arrays) in a sub scanning direction perpendicular to the main scanning directions so as to eject ink droplets in a downward direction. The recording heads 4*y*, 4*m*, 4*c*, and 4*k* may be collectively referred to as "recording heads 4" when no distinction is made between them.

As a liquid ejecting head forming each of the recording heads 4, one may be used that includes a piezoelectric actuator such as a piezoelectric element, a thermal actuator that uses a phase change due to the film boiling of liquid using an electrothermal conversion element such as a heat element, a shape memory alloy actuator using a metal phase change due to a change in temperature, or an electrostatic actuator using an electrostatic force as a pressure generating part configured to generate pressure for ejecting liquid droplets.

On the other hand, in order to convey paper 10, the image forming apparatus includes a conveyor belt 12 for electrostatically attracting and adhering the paper 10 and conveying the paper 10 at a position opposed to the recording heads 4. The conveyor belt 12, which is an endless belt, is engaged with and stretched between a conveying roller 13 and a tension roller 14 to rotate in a belt conveyance direction (the sub scanning direction), and is charged (provided with an electric charge) with a charging roller 15 while rotating. The conveyor belt 12 is caused to rotate in the sub scanning direction by the conveying roller 13 being rotated through a timing belt and a timing pulley by a sub scanning motor 216 (FIG. 4), whose graphical illustration is omitted in FIG. 1 through FIG. 3.

Further, the image forming apparatus includes a maintenance and recovery mechanism 20 configured to maintain and recover the recording heads 4, and a flushing receiver 21 to which flushing (blank ejection) is performed from the recording heads 4. The maintenance and recovery mechanism 20 and the flushing receiver 21 are placed on one side and on the other side, respectively, of the carriage 3 in the main scanning directions beside the conveyor belt 12.

The maintenance and recovery mechanism 20 includes, for example, four'capping members 31 configured to cap the nozzle faces (faces where nozzles are formed) of the four recording heads 4, a wiping member 32 configured to wipe the nozzle faces, and a flushing receiver 33 configured to receive blank ejection droplets, or liquid droplets that do not contribute to image forming.

Further, the image forming apparatus includes a first encoder scale 23 on which a predetermined pattern is formed and a first encoder sensor 24 formed of a transmission photosensor configured to read the pattern of the first encoder scale 23. The first encoder scale 23 is stretched between the side plates 110R and 110L along the main scanning directions of the carriage 3. The first encoder sensor 24 is provided in the carriage 3. The first encoder scale 23 and the first encoder sensor 24 form a first linear encoder (a main scanning encoder) 25 configured to detect the movement (travel) of the carriage 3.

On the other hand, a vibration damping member 42 as an antiphase member is slidably held with a main guide rod 41 and a sub guide member (not graphically illustrated) provided laterally between the right side plate 110R and the left side plate 110L. The vibration damping member 42 is connected to a portion of the timing belt 8 on the side opposite to the carriage 3. The vibration damping member 42 moves (travels) in a direction opposite to the traveling direction of the carriage 3, thereby preventing vibrations caused by the movement of the carriage 3 in particular. The vibration damping member 42 is a body having substantially the same mass as the carriage 3.

Further, the image forming apparatus includes a second encoder scale 43 on which a predetermined pattern is formed and a second encoder sensor 44 formed of a transmission photosensor configured to read the pattern of the second encoder scale 43. The second encoder scale 43 is stretched between the side plates 110R and 110L along the main scanning directions of the vibration damping member 42. The second encoder sensor 44 is provided in the vibration damping member 42. The second encoder scale 43 and the second encoder sensor 44 form a second linear encoder 45 configured to detect the movement (travel) of the vibration damping member 42.

The second encoder scale 43 of the second linear encoder 45 has the same pattern arrangement as the first encoder scale 23 of the first linear encoder 25, so that the same detection pulses are obtained from the first linear encoder 25 and the second linear encoder 45 when there is no slack or variations in the timing belt 8.

Further, the image forming apparatus includes a partition member 46 provided along the main scanning directions between the carriage 3 and the vibration damping member 42 so as to partition the space between the carriage 3 and the vibration damping member 42, thereby preventing mist caused by ejection of liquid droplets from the recording heads 4 of the carriage 3 from being scattered to the side of the vibration damping member 42.

In the image forming apparatus thus configured, the paper 10 is fed from the paper feed cassette 103 or a paper feed tray (not graphically illustrated) onto the charged conveyor belt 12 to be attracted and adhered to the conveyor belt 12, and the paper 10 is conveyed in the sub scanning direction with the rotation of the conveyor belt 12. Then, by driving the recording heads 4 in accordance with an image signal while moving the carriage 3 in the main scanning direction, ink droplets are ejected onto the stationary paper 10 to perform recording for one line. Then, after conveying the paper 10 for a predetermined amount (distance), recording is performed for the next line. In response to receiving a recording completion signal or a signal that indicates the arrival of the rear (trailing) end of the paper 10 at a recording area, the recording operation is terminated and the paper 10 is discharged onto the paper output tray 104.

Figure 4:
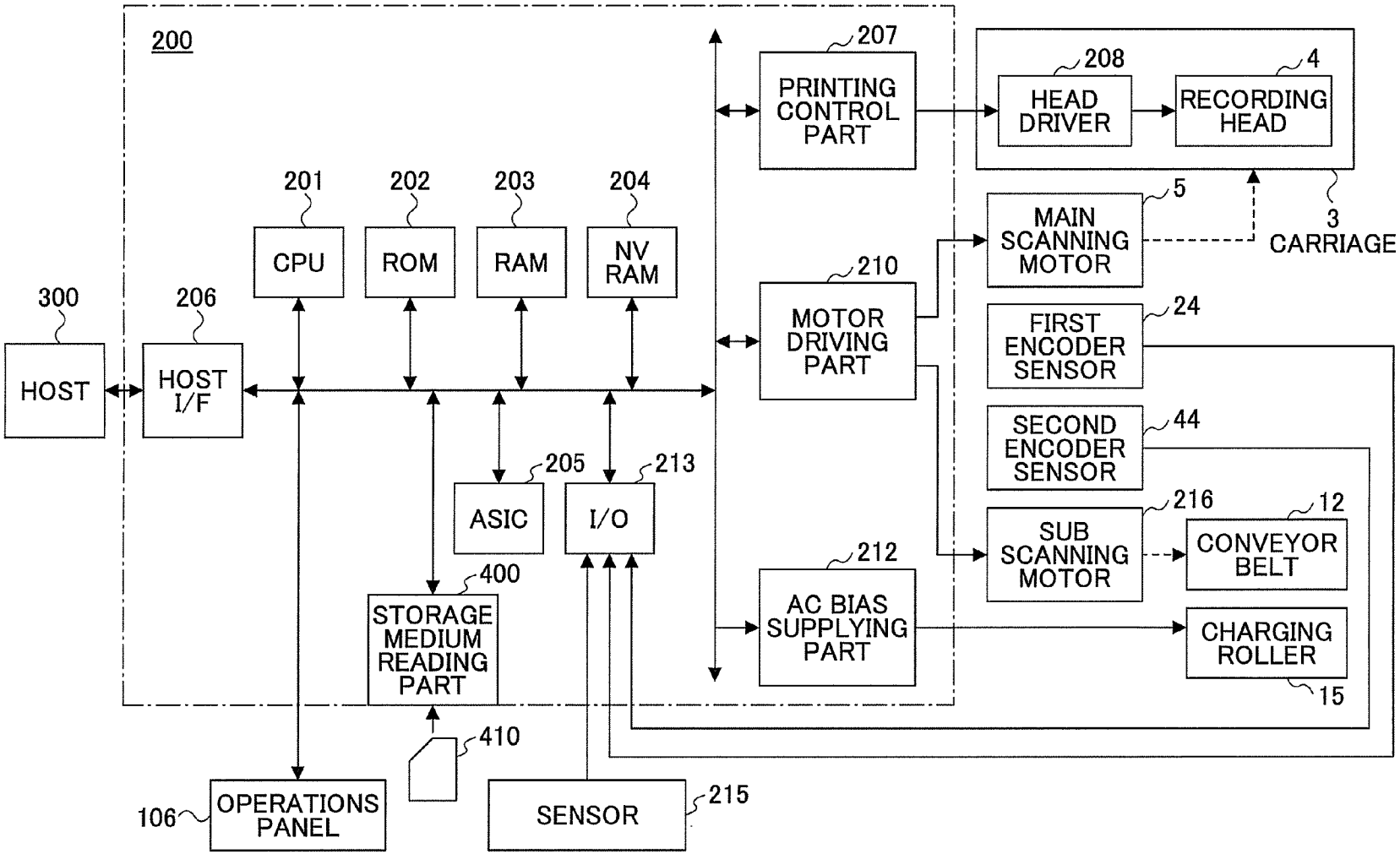
FIG. 4 is a schematic block diagram illustrating a control part of the image forming apparatus according to the first embodiment of the present invention.

Next, an overview is given, with reference to FIG. 4, of a control part 200 of the image forming apparatus. FIG. 4 is a block diagram illustrating the control part 200 of the image forming apparatus.

The control part 200, which manages control of the entire image forming apparatus, includes a central processing unit (CPU) 201, a read-only memory (ROM) 202, a random access memory (RAM) 203, a rewritable nonvolatile memory 204, and an application-specific integrated circuit (ASIC) 205. The CPU 201 serves as a part to perform determination according to embodiments of the present invention and a part to control the movement (travel) of the carriage 3. The ROM 202 contains various programs and other fixed data. The programs include a program for causing the CPU 201 to execute control (processing) according to embodiments of the present invention. The RAM 203 is configured to temporarily store data such as image data. The nonvolatile memory 204 is configured to retain data even when the image forming apparatus is turned off. The ASIC 205 is configured to process input/output signals for various signal processes with respect to image data, for image processing that performs sorting, and for controlling the entire apparatus.

The control part 200 further includes an interface (I/F) 206 for transmitting data and signals to and receiving data and signals from the host side, a printing control part 207, a head driver (driver IC) 208 for driving the recording heads 4, a motor driving part 210 for driving the main scanning motor 5 and the sub scanning motor 216, an AC bias supplying part 212 configured to supply the charging roller 15 with AC bias, and an input/output (I/O) part 213 for inputting detection signals from the first encoder sensor 24 and the second encoder sensor 44 and detection signals from various sensors such as a temperature sensor 215 configured to detect an ambient temperature as the cause of misalignment of dot formation positions. The printing control part 207 includes a data transfer part configured to transfer data for driving and controlling the recording heads 4 and a driving waveform generating part configured to generate a driving waveform. The head driver 208 is provided on the carriage 3 side. Further, the operations panel 106 (FIG. 1) for inputting and displaying information necessary for the image forming apparatus is connected to the control part 200.

Here, the control part 200 is configured to receive image data from the host side at the I/F 206 through a cable or a network such as a local area network (LAN) or the Internet. These image data include those from an information processor (host) 300 such as a personal computer, an image reader such as an image scanner, and an image capturing device such as a digital camera.

The CPU 201 of the control part 200 causes printing data in a reception buffer included in the I/F 206 to be read and analyzed to be subjected to necessary image processing and data sorting in the ASIC 205. Then, the CPU 201 causes these image data to be transferred from the printing control part 207 to the head driver 208. The generation of dot pattern data for outputting an image is performed in a host-side printer driver.

The printing control part 207 transfers the image data in serial form to the head driver 208, and outputs a transfer clock signal, a latch signal, and a droplet control signal (mask signal) necessary for transferring these image data and finalizing this transfer. In addition, the printing control part 207 includes a digital-to-analog (D/A) converter configured to perform D/A conversion on the pattern data of a driving signal contained in the ROM 202, a driving waveform generating part including a voltage amplifier and a current amplifier, and a driving waveform selecting part configured to select a driving waveform to be provided to the head driver 208. The printing control part 207 generates a driving waveform formed of a single driving pulse (driving signal) or multiple driving pulses (driving signals), and outputs the generated driving waveform to the head driver 208.

The head driver 208 drives each of the recording heads 4 by selectively applying a driving signal forming the driving waveform provided from the printing control part 207 based on serially-input image data corresponding to one line of the recording head 4 to the driving element (such as a piezoelectric element as described above) of the recording head 4 that generates energy for ejecting liquid droplets. At this point, by selecting driving pulses for the driving waveform, it is possible to form dots of different sizes, such as a large droplet (a large dot), a medium droplet (a medium dot), and a small droplet (a small dot).

Further, the CPU 201 calculates a drive output value (a control value) for the main scanning motor 5 based on a detected speed value and a detected position value obtained by sampling detection pulses from the first encoder sensor 24 of the first linear encoder 25 and on a target speed value and a target position value obtained from a prestored speed and position profile, and drives the main scanning motor 5 via the motor driving part 210. Likewise, the CPU 201 calculates a drive output value (a control value) for the sub scanning motor 216 based on a detected speed value and a detected position value obtained by sampling detection pulses from the encoder sensor of a linear encoder for sub scanning (not graphically illustrated) and on a target speed value and a target position value obtained from a prestored speed and position profile, and drives the sub scanning motor 216 via the motor driving part 210.

Further, when the first linear encoder 25 is prevented from performing accurate detection because of contamination such as dirt or when the carriage 3 is in a contaminated (dirty) region of the first linear encoder 25, the CPU 201 calculates a drive output value (a control value) for the main scanning motor 5 based on a detected speed value and a detected position value obtained by sampling detection pulses from the second encoder sensor 44 of the second linear encoder 45 and on a target speed value and a target position value obtained from a prestored speed and position profile, and drives the main scanning motor 5 via the motor driving part 210. A description of this is given in detail below.

Detection signals from various sensors such as the temperature sensor 215 are input to the control part 200. Further, the operations panel 106 for inputting and displaying information necessary for the image forming apparatus is connected to the control part 200.

Next, a description is given, with reference to FIG. 5 through FIGS. 7A and 7B, of detection of a carriage position and a malfunction caused by encoder contamination in this image forming apparatus.

Figure 5:
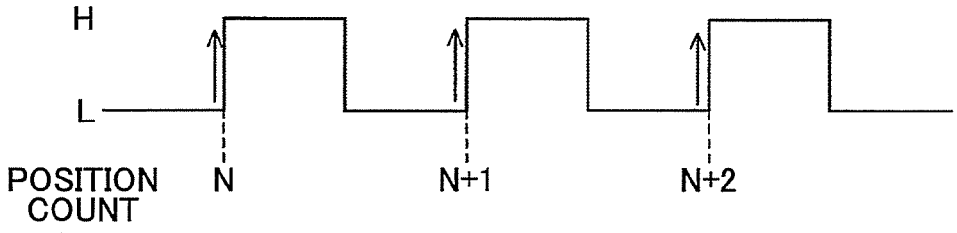
FIG. 5 is a diagram for illustrating an encoder signal from an encoder sensor and a position count according to the first embodiment of the present invention.

First, detection pulses as illustrated in FIG. 5 (of a shape after signal processing), which may be hereinafter also referred to as "encoder signal," are input from the first encoder sensor 24, configured to read the first encoder scale 23 in accordance with the travel and scanning of the carriage 3, to the control part 200. The position of the carriage 3 is detected by performing counting by incrementing or decrementing an internal position count using a rise (or fall) of this encoder signal from LOW (L) to HIGH (H) (or HIGH to LOW) as a trigger.

Figure 6:
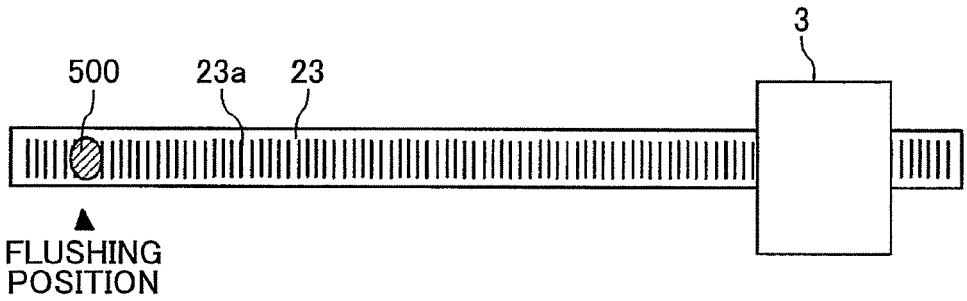
FIG. 6 is a plan view of an encoder scale according to the first embodiment of the present invention, illustrating contamination of the encoder scale.
Figure 7A:
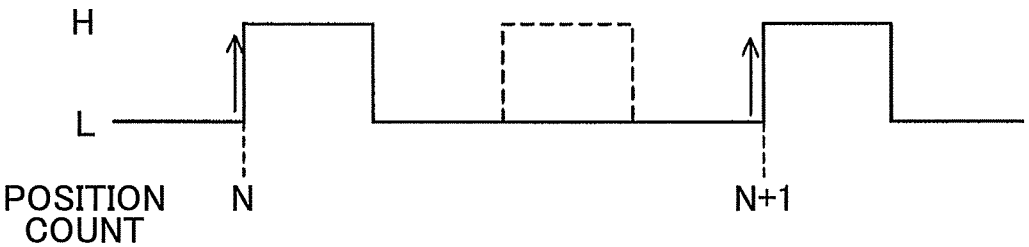
FIGS. 7A and 7B are diagrams for illustrating the contamination of the encoder scale and erroneous detection of the encoder signal according to the first embodiment of the present invention.
Figure 7B:
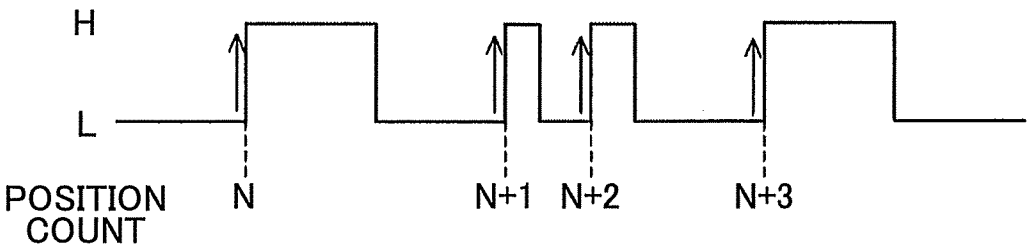

Here, for example, if there is a contamination (contaminated region) 500 in the first encoder scale 23 as illustrated in FIG. 6, the encoder signal is not output correctly, so that the carriage 3 may be mispositioned. For example, if a position identifying part (slit) 23*a* of the first encoder scale 23 is skipped in reading the first encoder scale 23, the count value is less than it is supposed to be as illustrated in FIG. 7A. On the other hand, if the position identifying part 23*a* of the first encoder scale 23 is read redundantly, the count value is more than it is supposed to be as illustrated in FIG. 7B.

When the encoder signal is not correctly output as described above, mispositioning of the carriage 3 occurs, so that the carriage 3 is prevented from traveling accurately to a target position. Further, the phenomena described above with reference to FIGS. 7A and 7B may occur in every single operation without fail or once in every few operations depending on factors such as the vibrations of slits of the first encoder scale 23 and the sensitivity of the first encoder sensor 24. Accordingly, as the number of times the first encoder sensor 24 passes a contaminated position increases, the carriage mispositioning becomes more likely to occur.

The contamination of the first encoder scale 23 as described above is often caused particularly by flushing operations performed toward the maintenance and recovery mechanism 20 and the flushing receiver 21 placed one at each end of a main scanning region. In flushing operations, ink droplets are ejected without landing on paper and/or the recording heads 4 are wiped. Therefore, ink mist is likely to float, so that there is a tendency for a contaminant such as dirt to easily adhere to slits (encoder slits) of the first encoder scale 23.

Figure 8:
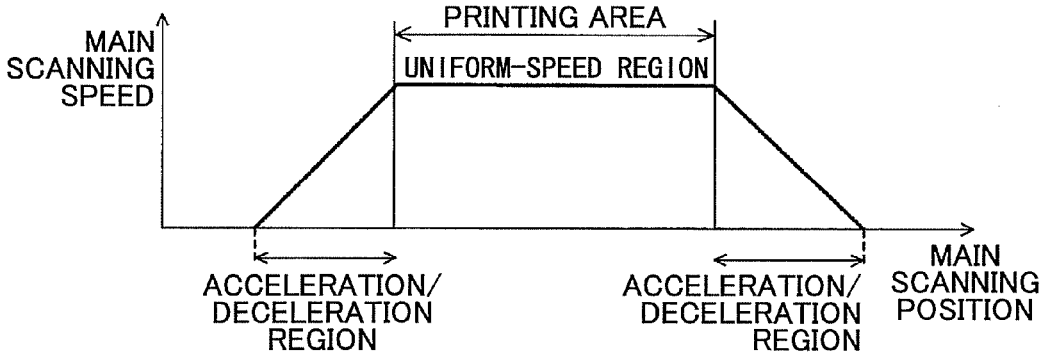
FIG. 8 is a diagram for illustrating a speed profile of a carriage according to the first embodiment of the present invention.

Next, a description is given, with reference to FIG. 8, of a speed profile in the main scanning operation of the carriage 3.

In the main scanning operation, in order to prevent misland ing of ink droplets on the paper 10, ink droplets are ejected while causing the carriage 3 to travel at a uniform speed in a printing area (on the paper 10), and an acceleration/deceleration region is provided before and after the uniform-speed region. In the acceleration/deceleration region before the uniform-speed region, the carriage 3 is accelerated until reaching the uniform speed. In the acceleration/deceleration region after the uniform-speed region, the carriage 3 is decelerated from the uniform speed.

The speed profile is contained and retained in, for example, the ROM 202. The CPU 201 counts detection pulses of the first encoder 25 or the second encoder 45 and calculates the position and the speed of the carriage 3 from the count value. Then, in the case of performing known proportional-integral-derivative (PID) control, the CPU 201 calculates a PID output control value (motor output value) in accordance with a deviation from a target speed obtained from the speed profile, and provides the motor driving part 210 with the calculated motor output value to drive and control the main scanning motor 5.

The following embodiments may be implemented in the image forming apparatus described above in the first embodiment.

Figure 9:
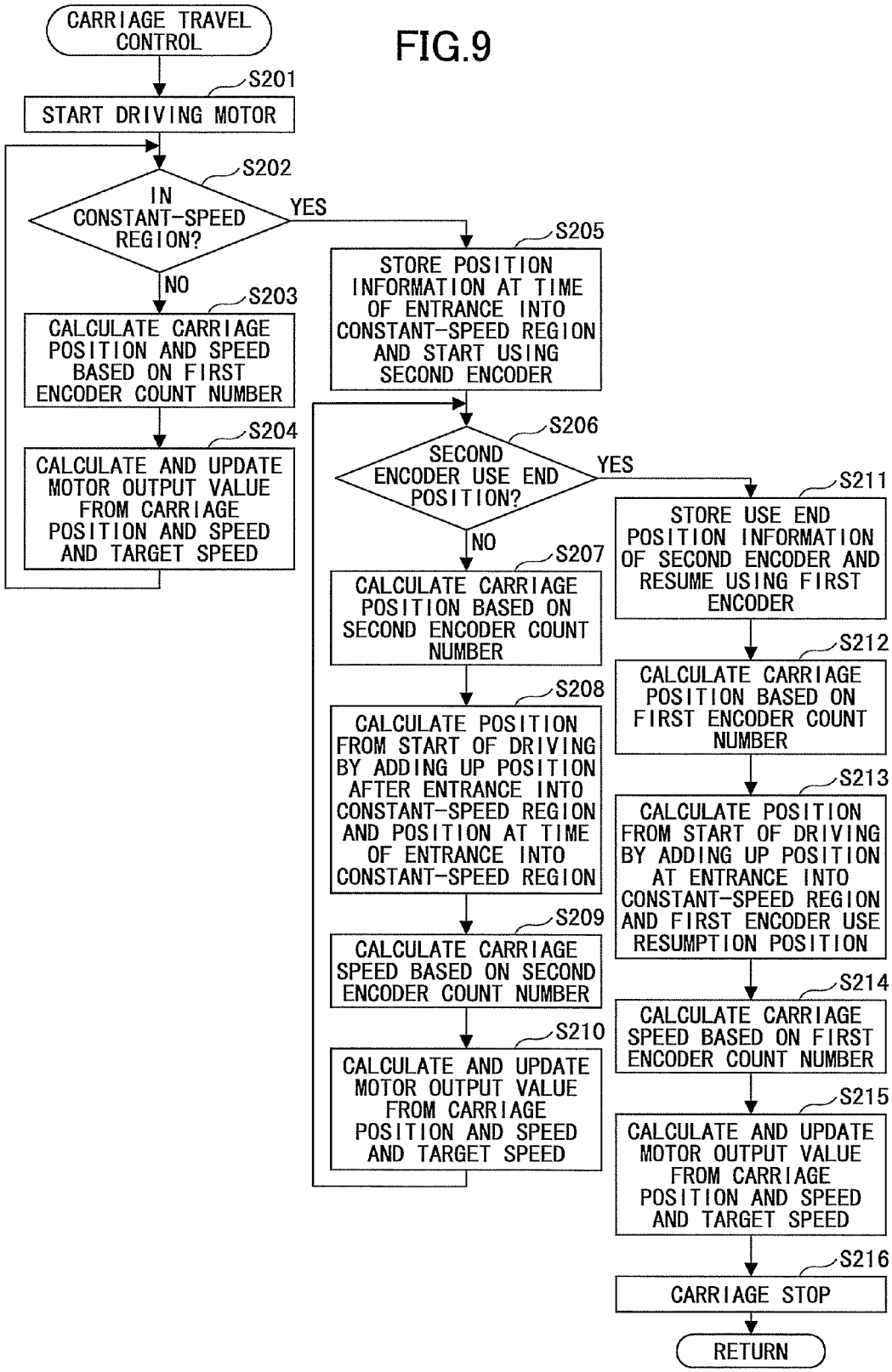
FIG. 9 is a flowchart for illustrating carriage travel control according to a second embodiment of the present invention.

Next, a description is given, with reference to the flowchart of FIG. 9, of carriage travel control according to a second embodiment of the present invention.

This embodiment illustrates the case of controlling the travel of the carriage 3 based on the detection result of the first linear encoder 25 in the acceleration/deceleration region and on the detection result of the second linear encoder 45 in the uniform-speed region (constant-speed region) of the carriage 3.

Referring to FIG. 9, in step S201, the driving of the main scanning motor 5 is started. Then, in step S202, it is determined whether the speed of the carriage 3 is in the constant-speed region (that is, whether the carriage 3 is at a constant speed). If the speed of the carriage 3 is not in the constant-speed region (NO in step S202), that is, in this case, if the speed of the carriage 3 is in the acceleration region, in step S203, detection pulses of the first linear encoder 25 are counted, and the position and the speed of the carriage 3 are calculated. Then, in step S204, a motor output value is calculated in accordance with the calculated values and a target speed obtained from a speed profile, thereby controlling the driving of the main scanning motor 5.

On the other hand, if the speed of the carriage 3 reaches a target speed and enters the constant-speed region (YES in step S202), in step S205, information on the position of the carriage 3 at the time of entering the constant-speed region obtained from the first linear encoder 25 is stored, and use of the second linear encoder 45 is started.

Within the constant-speed region, the position and the speed of the carriage 3 are calculated using the count number of the second linear encoder 45 in steps S207 through S210.

That is, in step S206, it is determined whether to end the use of the second linear encoder 45. Here, whether to end the use of the second linear encoder 45 is determined by determining whether the carriage 3 has traveled (moved) (to a position of) a prescribed (predetermined) step number (count number) from the deceleration start position of the carriage 3.

At this point, if the use of the second linear encoder 45 is not to be ended (NO in step S206), in step S207, the position of the carriage 3 (the distance traveled by the carriage 3) after the entrance into the constant-speed region is calculated based on the count number of the second linear encoder 45. Then, in step S208, since the position (distance) from the use start point of the second linear encoder 45 may be determined (identified) based on the count number of the second linear encoder 45, the position of the carriage 3 from the operation start position is calculated by adding up this determined position and the position of the switching to the use of the second linear encoder 45 stored in step S205.

Thereafter, in step S209, the speed of the carriage 3 is calculated based on the count number of detection pulses of the second linear encoder 45. Then, in step S210, a motor output value is calculated in accordance with the position and the speed of the carriage 3 obtained as described above and a target speed from a speed profile, thereby controlling the driving of the main scanning motor 5.

Within the constant-speed region, the position of the carriage 3 is checked (in step S206), and when the deceleration start position approaches and the carriage 3 reaches the position of switching back again to the use of the first linear encoder 25 on the carriage 3 side (YES in step S206), in step S211, the use end position of the second linear encoder 45, where the use of the second linear encoder 45 ends, is stored, and the use of the first linear encoder 25 is resumed.

Thereafter, in step S212, the position of the carriage 3 after its entrance into the deceleration region is calculated based on the count number of the first linear encoder 25. Then, in step S213, the position of the carriage 3 from the operation start position is calculated by adding up the position of the carriage 3 at its entrance into the constant-speed region and the position of the switching to the use of the first linear encoder 25.

Then, in step S214, the speed of the carriage 3 is calculated based on the count number of detection pulses of the first linear encoder 25 on the carriage 3 side. Then, in step S215, a motor output value is calculated in accordance with the position and the speed of the carriage 3 obtained as described above and a target speed from a speed profile, thereby controlling the driving of the main scanning motor 5.

Then, in step S215, the carriage 3 is stopped.

Thus, according to this embodiment, the travel of a carriage is controlled in accordance with the detection results of a first encoder on the carriage side and a second encoder on the antiphase member side, whose travel and scanning are opposite in phase from the carriage. Accordingly, even if a carriage-side encoder scale is contaminated, it is possible to control the travel of the carriage using a second encoder including an encoder sheet (scale) on the antiphase member side, positioned relatively distant from a recording head. Therefore, it is possible to reduce or prevent malfunction due to encoder scale contamination with a simple configuration.

In particular, controlling the travel of the carriage using the detection result of the first encoder in an acceleration/deceleration region and using the detection result of the second encoder in a constant-speed region makes it possible to detect the position of the carriage with accuracy.

That is, in the case of detecting the position of the carriage 3 using the first linear encoder 25 on the carriage 3 side, since the first linear encoder 25 is contaminated with ink mist, consideration may be given to using the second linear encoder 45 on the vibration damping member 42 side, which is (distant from a mist source and) less likely to suffer adhesion of ink mist. In this case, however, since the carriage 3 and the vibration damping member (antiphase member) 42 are connected with the timing belt 8, the occurrence of slack in the timing belt 8 may cause mismatching in the correspondence between the carriage 3 and the vibration damping member 42 at the time of acceleration or deceleration of the carriage 3. Therefore, according to this embodiment, the first linear encoder 25 on the carriage 3 side is used at the time of accelerating or decelerating the carriage 3 (even if the first linear encoder 25 is contaminated), and the second linear encoder 45 on the vibration damping member 42 side is used at the time of the travel of the carriage 3 at a constant speed. As a result, the accuracy of the detection of the position of the carriage 3 at the time of forming an image is improved, so that it is possible to prevent image quality disturbance.

Figure 10:
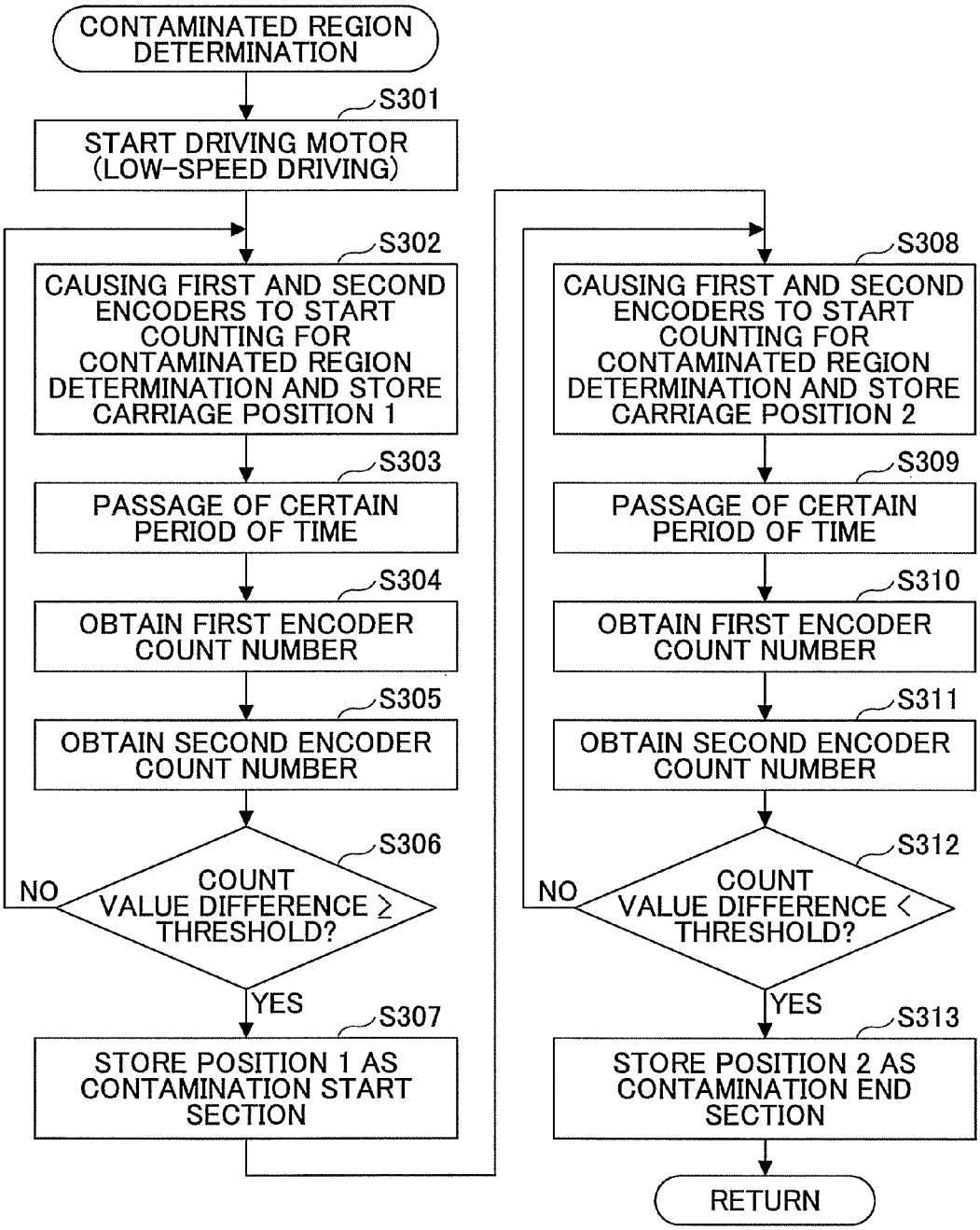
FIG. 10 is a flowchart for illustrating contaminated region detection according to a third embodiment of the present invention.

Next, a description is given, with reference to the flowchart of FIG. 10, of a third embodiment of the present invention.

This embodiment illustrates the case of detecting a contaminated region of the first encoder scale 23 on the carriage 3 side.

That is, first, in step S301, the driving of the main scanning motor 5 is started at a speed that causes no slack of the timing belt 8. Then, in step S302, the first linear encoder 25 and the second linear encoder 45 are caused to start counting for determining a contaminated region, and the position of the carriage 3 at this point is stored (as Position 1). After passage of a certain period of time in step S303, in step S304, a count number (value) of the first linear encoder 25 is obtained, and in step S305, a count number (value) of the second linear encoder 45 is obtained. Then, in step S306, it is determined whether the difference between the count values of the two encoders 25 and 45 is more than or equal to a predetermined threshold.

Here, when the carriage 3 enters a contaminated region of the first linear encoder 25, the count value of the first linear encoder 25 on the carriage 3 side becomes less than the count value of the second linear encoder 45 on the vibration damping member 42 side. Therefore, if the difference between the count values is more than or equal to a threshold (YES in step S306), in step S307, Position 1 stored in step S302 is stored as a contaminated region start position (a contamination start section).

Thereafter, in step S308, likewise, the first linear encoder 25 and the second linear encoder 45 are caused to start counting for determining the contaminated region, and the position of the carriage 3 at this point is stored (as Position 2). After passage of a certain period of time in step S309, in step S310, a count number (value) of the first linear encoder 25 is obtained, and in step S311, a count number (value) of the second linear encoder 45 is obtained. Then, in step S312, it is determined whether the difference between the count values of the two encoders 25 and 45 is less than the predetermined threshold.

Here, when the carriage 3 leaves a contaminated region of the first linear encoder 25, the difference between the count value of the second linear encoder 45 on the vibration damping member 42 side and the count value of the first linear encoder 25 on the carriage 3 side is reduced. Therefore, if the difference between the count values is less than the threshold (YES in step S312), in step S313, Position 2 stored in step S308 is stored as a contaminated region end position (a contamination end section).

Thus, it is possible to detect Position 1 through Position 2 of the first linear encoder 25 as a contaminated region. Accordingly, it is possible to avoid the contaminated region in performing acceleration or deceleration and to control the travel of the carriage 3 using the second linear encoder 45 in the contaminated region.

Figure 11:
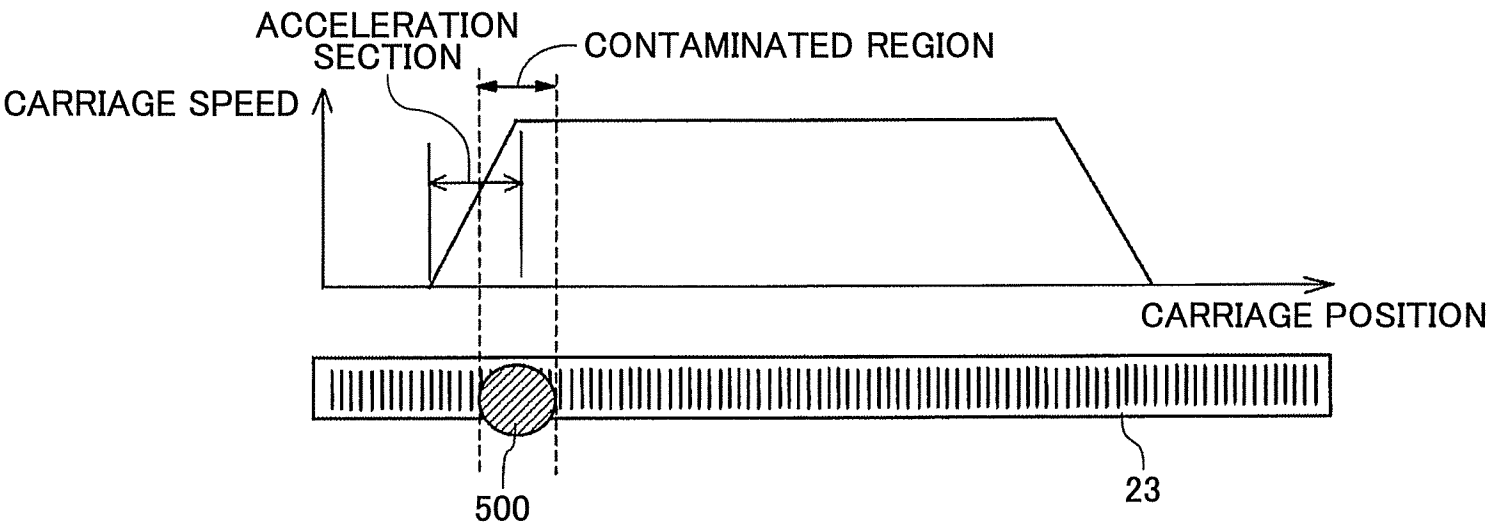
FIG. 11 is a diagram for illustrating a fourth embodiment of the present invention.
Figure 12:
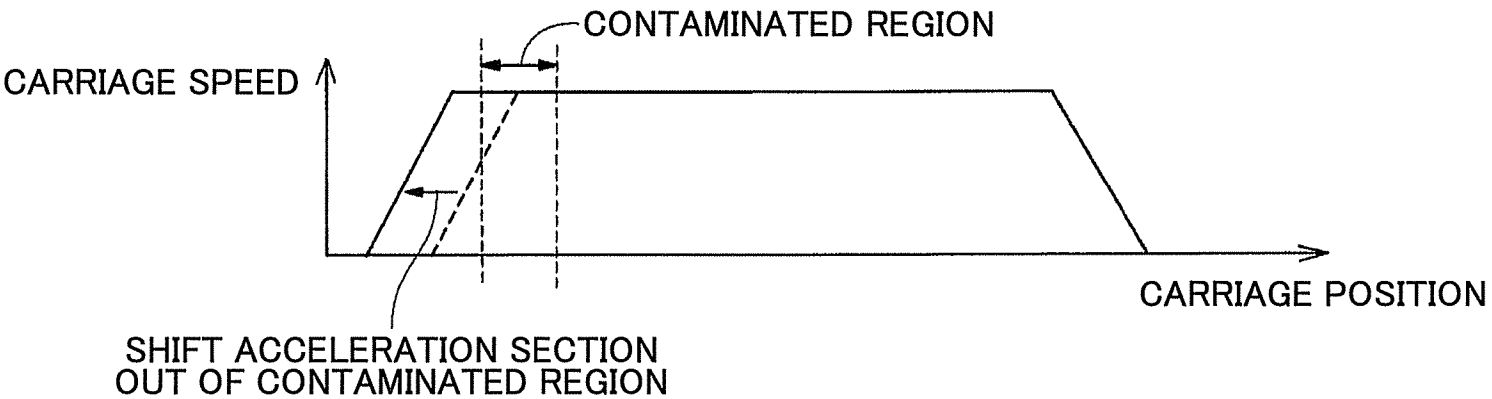
FIG. 12 is a diagram for illustrating a change (shift) in the operation start position of the carriage according to the fourth embodiment of the present invention.

Next, a description is given, with reference to FIG. 11 and FIG. 12, of a fourth embodiment of the present invention.

At the time of printing, constantly moving the carriage 3 from one end to the other of the main scanning region reduces printing speed. Therefore, in the case of a narrow printing area, the traveling (moving) range of the carriage 3 is narrowed to increase printing speed. For example, such control is performed as to move the carriage 3 from a printing end position in a scan to a printing start position in the next scan in the shortest period.

At this point, acceleration or deceleration may be performed in a region with the contamination 500 (here referred to as "contaminated region 500") in the traveling region of the carriage 3 as illustrated in FIG. 11. In this case, the first linear encoder 25 on the carriage 3 side would be used in the contaminated region 500. Therefore, it is desired to prevent the acceleration/deceleration region from overlapping the contaminated region 500.

Therefore, according to this embodiment, such control is performed as to offset the traveling start position of the carriage 3 so that the acceleration region of the carriage 3 does not overlap the contaminated region 500. Likewise, in the case of preventing the deceleration region of the carriage 3 from overlapping the contaminated region 500, such control is performed as to offset the traveling end position of the carriage 3. Since the length of the acceleration (deceleration) section is predetermined, a point distant from the contaminated region 500 by the length of the acceleration (deceleration) section may be determined as the traveling start (end) position. The contaminated region 500 may be detected as described above in the third embodiment.

Figure 13:
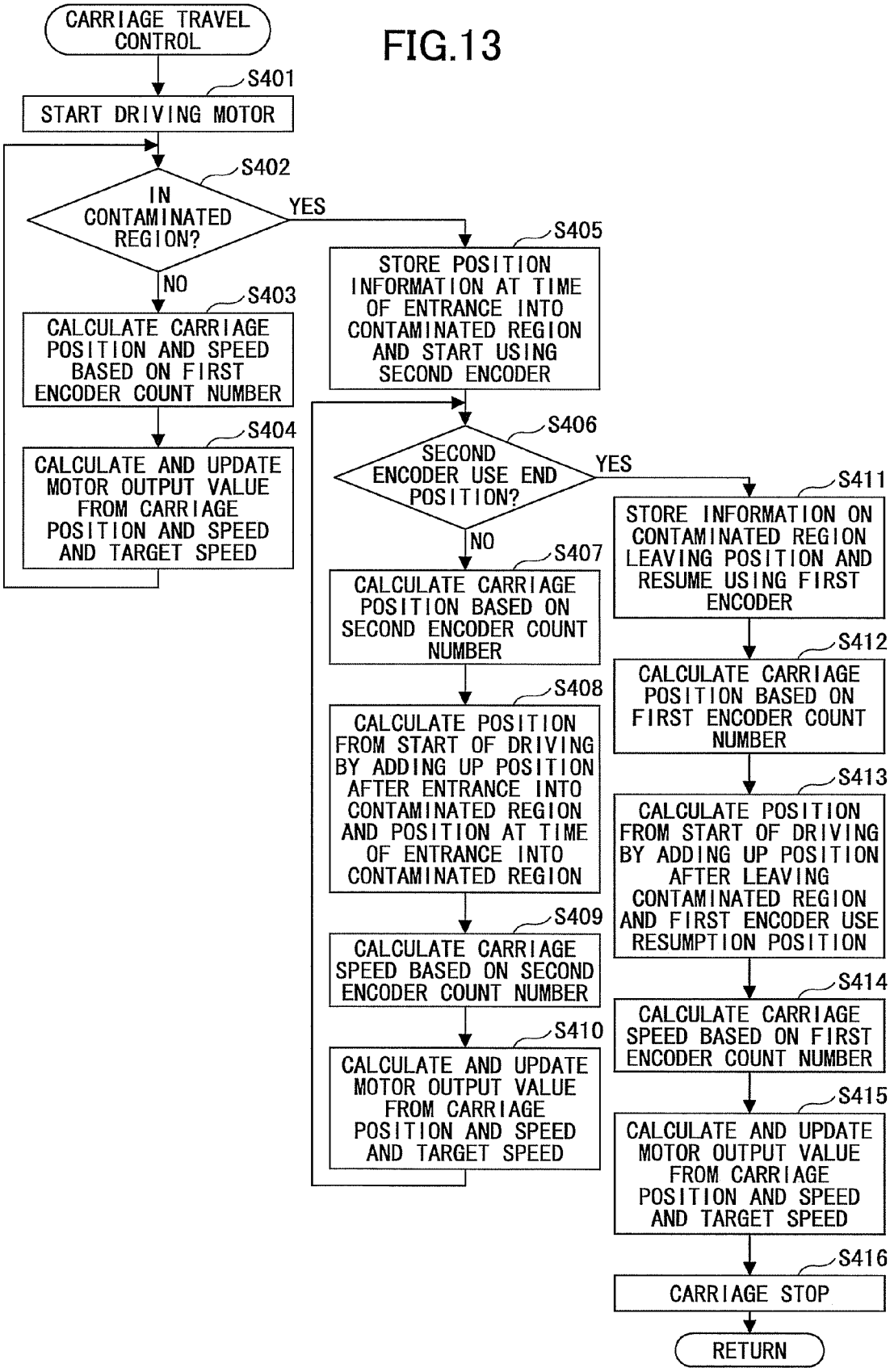
FIG. 13 is a flowchart for illustrating carriage travel control according to a fifth embodiment of the present invention.

Next, a description is given, with reference to the flowchart of FIG. 13, of a fifth embodiment of the present invention.

This embodiment illustrates the case of controlling the travel of the carriage 3 based on the detection result of the first linear encoder 25 in a region free of contamination (uncontaminated region) and on the detection result of the second linear encoder 45 in a contaminated region.

That is, in step S401, the driving of the main scanning motor 5 is started, and in step S402, it is determined whether the position of the carriage 3 is in a contaminated region (that is, whether the position of the carriage 3 has entered a contaminated region). If the position of the carriage 3 has not entered a contaminated region (NO in step S402), in step S403, detection pulses of the first linear encoder 25 are counted, and the position and the speed of the carriage 3 are calculated. Then, in step S404, a motor output value is calculated in accordance with the calculated values and a target speed obtained from a speed profile, thereby controlling the driving of the main scanning motor 5. In step S402, whether the carriage 3 has entered a contaminated region is determined based on the latest position information.

On the other hand, if the position of the carriage 3 has entered a contaminated region (YES in step S402), in step S405, information on the position of the carriage 3 at the time of entering the contaminated region obtained from the first linear encoder 25 is stored, and use of the second linear encoder 45 is started.

Then, in step S406, it is determined whether to end the use of the second linear encoder 45. Here, whether to end the use of the second linear encoder 45 is determined by determining whether the position of the carriage 3 is out of the contaminated region (that is, whether the carriage 3 has departed the contaminated region).

At this point, if the use of the second linear encoder 45 is not to be ended (NO in step S406), in step S407, the position of the carriage 3 (the distance traveled by the carriage 3) after its entrance into the contaminated region is calculated based on the count number of the second linear encoder 45. Then, in step S408, since the position (distance) from the use start point of the second linear encoder 45 may be determined (identified) based on the count number of the second linear encoder 45, the position of the carriage 3 from the operation start position is calculated by adding up this determined position and the position of the switching to the use of the second linear encoder 45 stored in step S405.

Thereafter, in step S409, the speed of the carriage 3 is calculated based on the count number of detection pulses of the second linear encoder 45. Then, in step S410, a motor output value is calculated in accordance with the position and the speed of the carriage 3 obtained as described above and a target speed from a speed profile, thereby controlling the driving of the main scanning motor 5.

Within the contaminated region, the position of the carriage 3 is checked (in step S406), and when the carriage 3 leaves the contaminated region and reaches the position of switching back again to the use of the first linear encoder 25 on the carriage 3 side (YES in step S406), in step S411, the use end position of the second linear encoder 45, where the use of the second linear encoder 45 ends, is stored, and the use of the first linear encoder 25 is resumed.

Thereafter, in step S412, the position of the carriage 3 (the distance traveled by the carriage 3) after leaving the contaminated region is calculated based on the count number of the first linear encoder 25. Then, in step S413, the position of the carriage 3 from the operation start position is calculated by adding up the position of the carriage 3 after leaving the contaminated region and the position of the switching to the use of the first linear encoder 25.

Then, in step S414, the speed of the carriage 3 is calculated based on the count number of detection pulses of the first linear encoder 25 on the carriage 3 side. Then, in step S415, a motor output value is calculated in accordance with the position and the speed of the carriage 3 obtained as described above and a target speed from a speed profile, thereby controlling the driving of the main scanning motor 5.

Then, in step S416, the carriage 3 is stopped.

That is, according to this embodiment, a first encoder on the carriage side is used from an operation start position through a position where the position of the carriage enters a contaminated region, and a second encoder is used in the contaminated region. Further, once the position of the carriage leaves the contaminated region, the first encoder on the carriage side is again used. Thus, by making the most of an carriage-side encoder sheet (scale), it is possible to perform control with more accuracy in the case where a slight slack of the timing belt causes error even in the constant-speed region.

Figure 14:
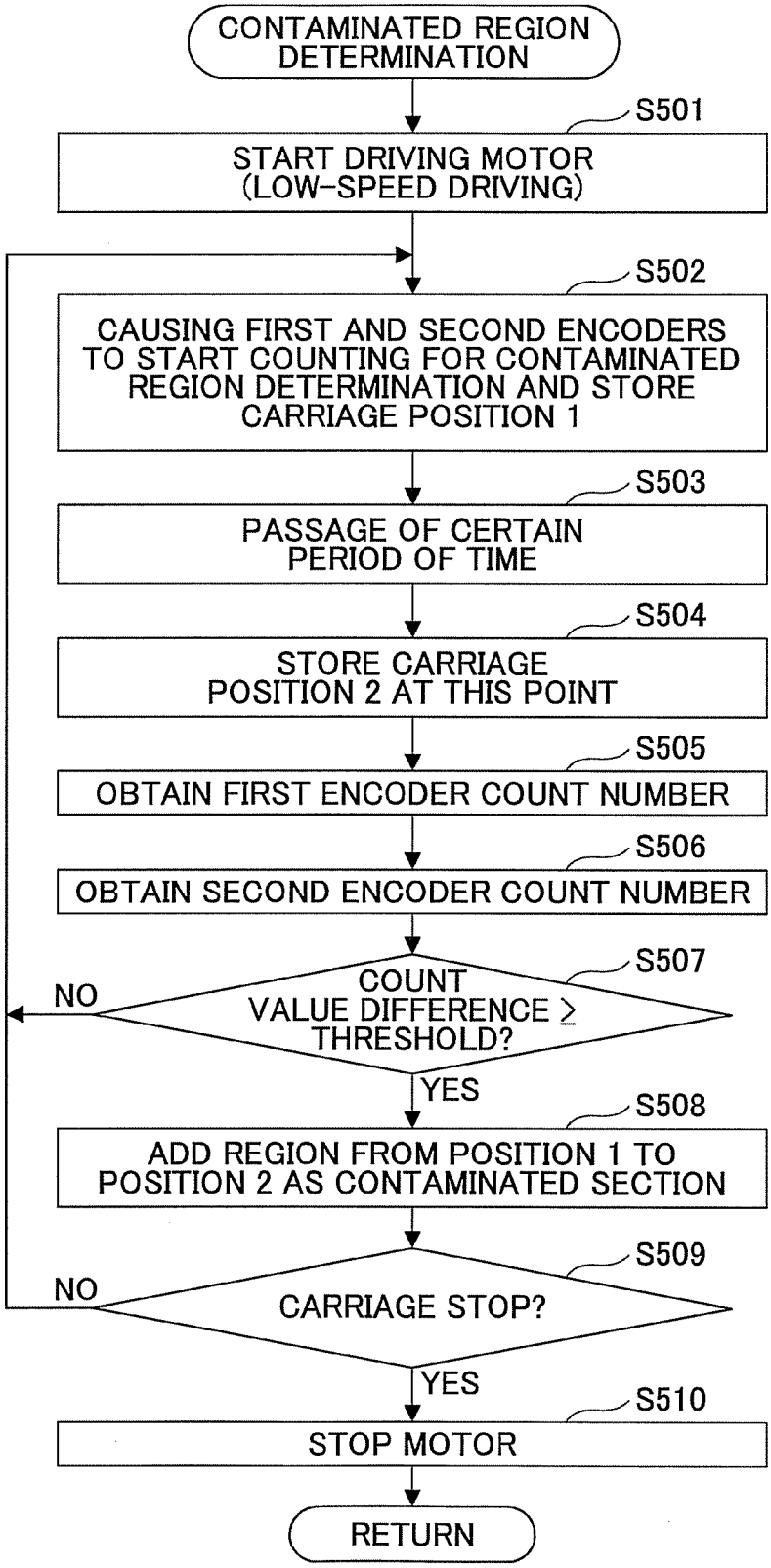
FIG. 14 is a flowchart for illustrating carriage travel control according to a sixth embodiment of the present invention.

Next, a description is given, with reference to the flowchart of FIG. 14, of a sixth embodiment of the present invention.

This embodiment illustrates the case of detecting the presence or absence of contamination in the entire region of the first encoder scale 23 of the first linear encoder 25.

That is, in step S501, the driving of the main scanning motor 5 is started at a speed that causes no slack of the timing belt 8. Then, in step S502, the first linear encoder 25 and the second linear encoder 45 are caused to start counting for determining a contaminated region, and the position of the carriage 3 at this point is stored (as Position 1). After passage of a certain period of time (step S503), in step S504, the position of the carriage 3 at this point is stored as Position 2.

Thereafter, in step S505, a count number (value) of the first linear encoder 25 is obtained, and in step S506, a count number (value) of the second linear encoder 45 is obtained. Then, in step S507, it is determined whether the difference between the count values of the two encoders 25 and 45 is more than or equal to a predetermined threshold.

If the difference between the count values is more than or equal to the threshold (YES in step S507), in step S508, the region between Position 1 to Position 2 stored is additionally stored as a contaminated region (section). If the difference between the count values is not more than or equal to the threshold (NO in step S507), the above-described process is repeated. Then, in step S509, it is determined whether the carriage 3 has come to a stop position. If the carriage 3 has come to the stop position (YES in step S509), in step S510, the main scanning motor 5 is stopped.

Thereby, it is possible to detect a contaminated region in the entire region of the first encoder scale 23.

Figure 15:
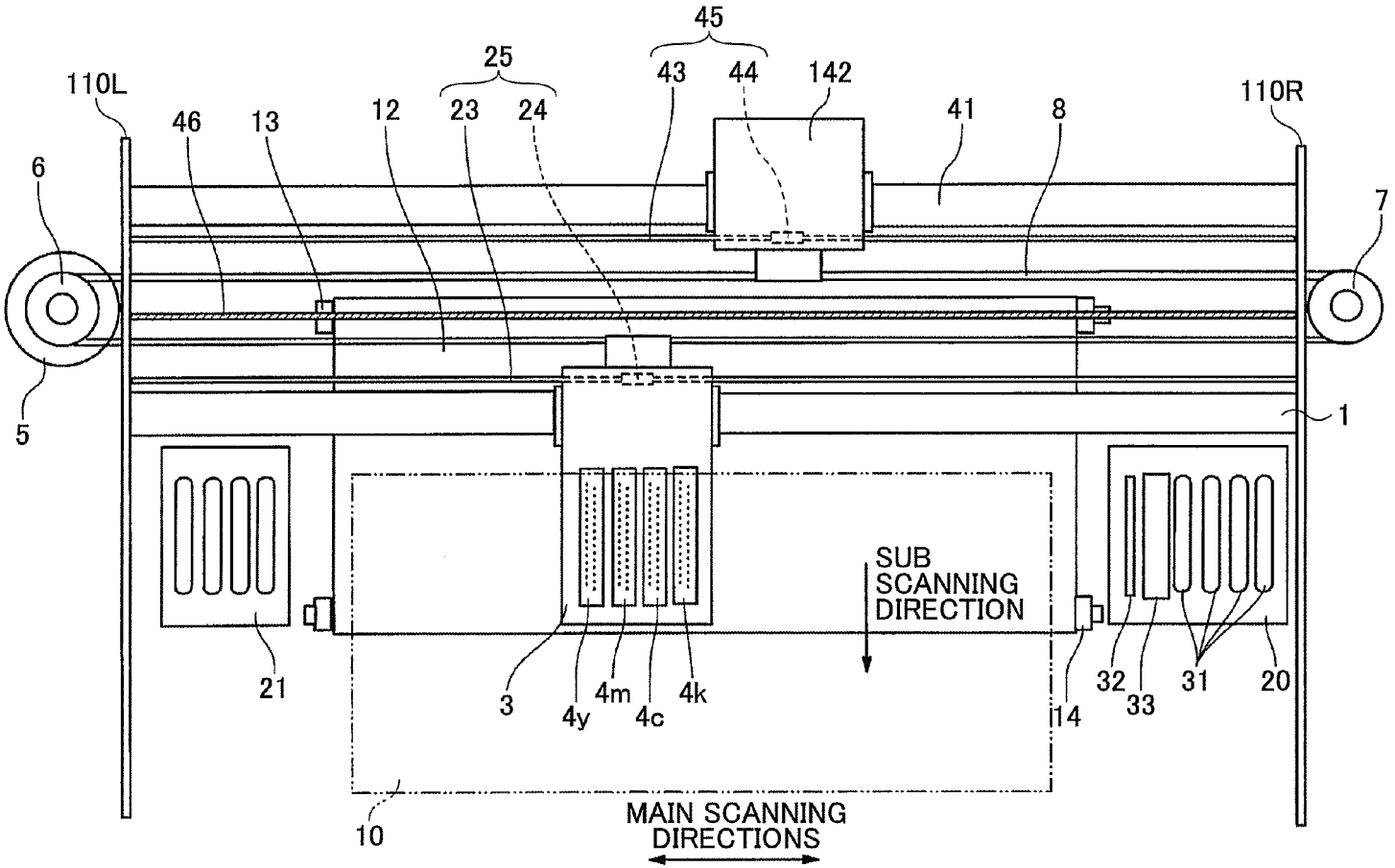
FIG. 15 is a schematic plan view of a mechanical part of the image forming apparatus according to a seventh embodiment of the present invention.

Next, a description is given, with reference to the plan view of FIG. 15, of a seventh embodiment of the present invention.

This embodiment includes an antiphase member 142 configured to travel in the main scanning directions in opposite phase from the carriage 3 without having a vibration damping member effect. The antiphase member 142 is different in mass from the carriage 3, but otherwise has the same configuration as that of the vibration damping member 42 described above with reference to FIG. 2.

In order to prevent error in carriage position detection due to contamination of a first (carriage-side) encoder scale, the antiphase member does not have to go so far as to have a vibration damping effect.

Figure 16:
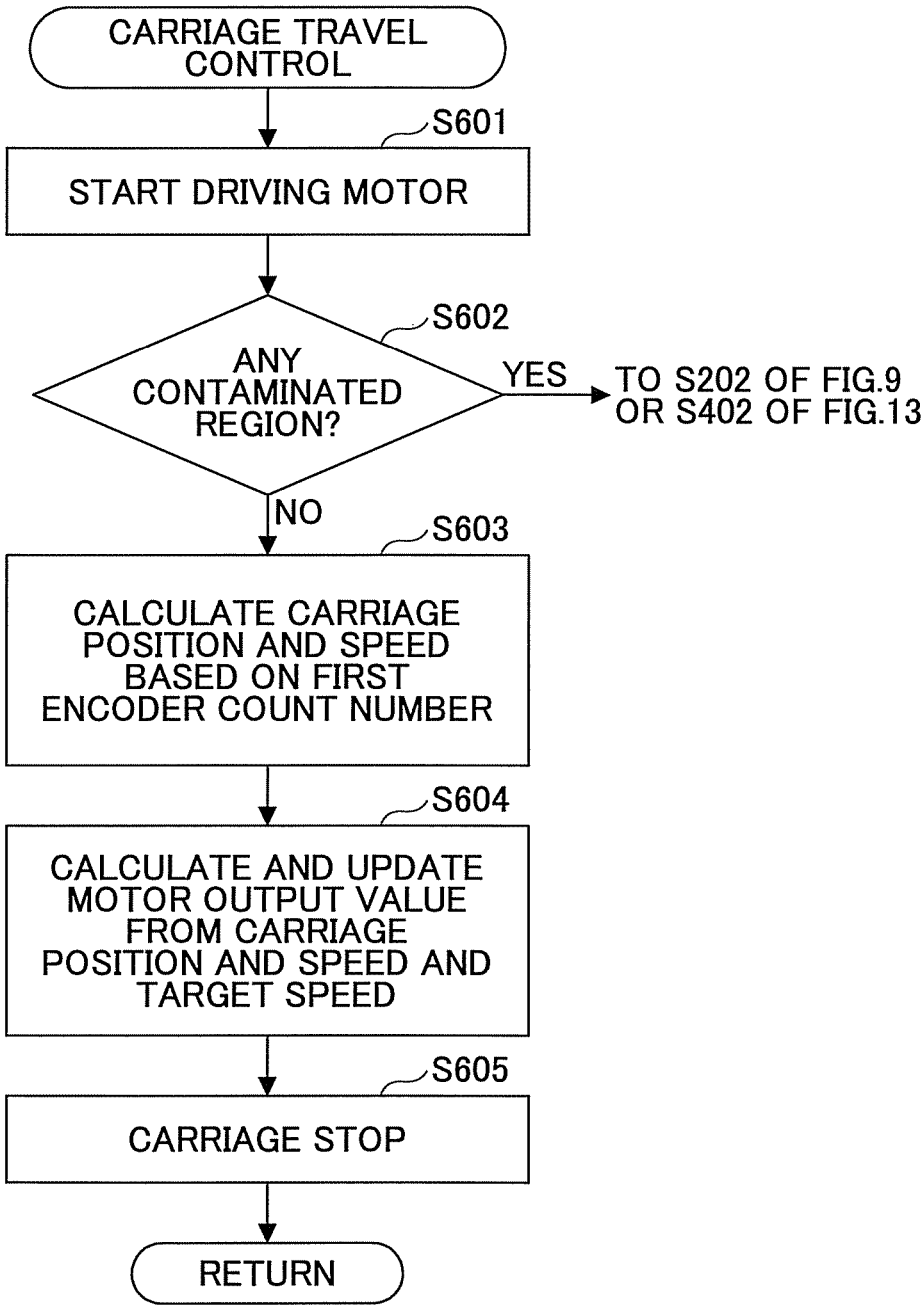
FIG. 16 is a flowchart for illustrating carriage travel control according to an eighth embodiment of the present invention.

Next, a description is given, with reference to the flowchart of FIG. 16, of an eighth embodiment of the present invention.

This embodiment illustrates the case of controlling the travel of the carriage 3 using only the detection result of the first linear encoder 25 if the first encoder scale 23 includes no contaminated region.

That is, in step S601, the driving of the main scanning motor 5 is started, and in step S602, it is determined whether the first encoder scale 23 includes a contaminated region. If the first encoder scale 23 includes a contaminated region (YES in step S602), the same process as in the above-described second or fifth embodiment is executed.

On the other hand, if the first encoder scale 23 has no contaminated region (NO in step S602), in step S603, detection pulses of the first linear encoder 25 are counted, and the position and the speed of the carriage 3 are calculated. Then, in step S604, a motor output value is calculated in accordance with the calculated values and a target speed obtained from a speed profile, thereby controlling the driving of the main scanning motor 5. In step S605, when the carriage 3 stops, the process ends.

This makes it possible to control the travel of a carriage with high accuracy by using a first (carriage-side) encoder only when a first (carriage-side) encoder scale is not contaminated.

As described above, it is possible to cause a computer to execute the above-described control of carriage travel using a first encoder and a second encoder and the above-described detection of a contaminated region of a first (carriage-side) encoder scale with a program stored in a ROM (the ROM 202 in FIG. 4, for example) or the like. This program may be stored in a storage medium 410 (FIG. 4) and provided via the storage medium 410. In this case, the storage medium 410 such as an SD card, a USB memory, or a CD-ROM is inserted into a storage medium reading part 400 (FIG. 4) of the control part 200. The storage medium reading part 400 may be an SD card slot in the case of the storage medium 410 being an SD card, for example. The storage medium reading part 400 may be a device suitable for the type of the storage medium 400 used. The program stored in the storage medium 410 is read in the storage medium reading part 400 to be loaded and executed by the CPU 201. This program may also be provided via a network such as the Internet (through the host I/F 206 in FIG. 4, for example). Further, the image forming apparatus described in the above embodiments and the host side (the information processor 300, for example) may be combined to form an image forming system.

According to one aspect of the present invention, an image forming apparatus is configured to control the travel (movement) of a carriage in accordance with the detection result of a carriage-side first encoder and the detection result of a second encoder on the side of an antiphase member caused to travel and scan in opposite phase from the carriage. Accordingly, even when a carriage-side encoder scale is contaminated, it is possible to control the travel of the carriage using the second encoder including an encoder sheet (scale) on the antiphase member side at a relatively distant position from recording heads. Thus, it is possible to reduce or prevent malfunction due to contamination of an encoder scale with a simple configuration.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that various changes, substitutions, and alterations could be made hereto without departing from the spirit and scope of the invention.

What is claimed is:

1. An image forming apparatus, comprising:

a carriage configured to travel with a recording head configured to eject liquid droplets being mounted thereon;

a first encoder including a first encoder scale placed along a traveling direction of the carriage and a first encoder sensor configured to read the first encoder scale;

an antiphase member configured to travel in opposite phase from the carriage;

a second encoder including a second encoder scale placed along a traveling direction of the antiphase member and a second encoder sensor configured to read the second encoder scale; and a control part configured to control a travel of the carriage in accordance with a detection result of the first encoder and a detection result of the second encoder;

wherein said image forming apparatus is configured to count a first detection pulse and a second detection pulse said first detection pulse being from said first encoder and obtained at an acceleration and deceleration region of said carriage, and said second detection pulse being from said second encoder and obtained at a uniform-speed region of said carriage; and wherein said image forming apparatus is configured to switch from using one of said first encoder and said second encoder to using the other of said first encoder and said second encoder.

2. The image forming apparatus as claimed in claim 1, wherein the antiphase member is a vibration damping member configured to prevent a vibration from being caused by an acceleration or deceleration of the carriage.

3. The image forming apparatus as claimed in claim 1, wherein the control part is configured to control the travel of the carriage in accordance with the detection result of the first encoder in the acceleration and deceleration region of the carriage and to control the travel of the carriage in accordance with the detection result of the second encoder in the uniform-speed region of the carriage.

4. The image forming apparatus as claimed in claim 1, wherein the control part is configured to determine a contaminated region of the first encoder by comparing the detection result of the first encoder and the detection result of the second encoder, and to control the travel of the carriage in accordance with the detection result of the second encoder in the contaminated region of the first encoder.

5. The image forming apparatus as claimed in claim 1, wherein the control part is configured to determine a presence or absence of a contaminated region of the first encoder by comparing the detection result of the first encoder and the detection result of the second encoder, and to control the travel of the carriage in accordance with only the detection result of the first encoder in response to determining the absence of the contaminated region of the first encoder.

6. A method of controlling carriage travel in an image forming apparatus, comprising:

reading, with a first encoder sensor of a first encoder, a first encoder scale thereof placed along a traveling direction of a carriage having a recording head configured to eject liquid droplets mounted thereon;

reading, with a second encoder sensor of a second encoder, a second encoder scale thereof placed along a traveling direction of an antiphase member configured to travel in opposite phase from the carriage;

controlling a travel of the carriage in accordance with a detection result of the first encoder based on said reading the first encoder scale and a detection result of the second encoder based on said reading the second encoder scale;

counting a first detection pulse and a second detection pulse, said first detection pulse being from said first encoder and obtained at an acceleration and deceleration region of said carriage, and said second detection pulse being from said second encoder and obtained at a uniform-speed region of said carriage; and switching from using one of said first encoder and said second encoder to using the other of said first encoder and said second encoder.

7. The method as claimed in claim 6, wherein the antiphase member is a vibration damping member configured to prevent a vibration from being caused by an acceleration or deceleration of the carriage.

8. The method as claimed in claim 6, wherein said controlling includes:

controlling the travel of the carriage in accordance with the detection result of the first encoder in the acceleration and deceleration region of the carriage; and controlling the travel of the carriage in accordance with the detection result of the second encoder in the uniform-speed region of the carriage.

9. The method as claimed in claim 6, wherein said controlling includes:

determining a contaminated region of the first encoder by comparing the detection result of the first encoder and the detection result of the second encoder; and controlling the travel of the carriage in accordance with the detection result of the second encoder in the contaminated region of the first encoder.

10. The method as claimed in claim 6, wherein said controlling includes:

determining a presence or absence of a contaminated region of the first encoder by comparing the detection result of the first encoder and the detection result of the second encoder; and controlling the travel of the carriage in accordance with only the detection result of the first encoder in response to determining the absence of the contaminated region of the first encoder.

11. A non-transitory computer-readable storage medium storing a program for causing a computer to execute a method of controlling carriage travel in an image forming apparatus, the method comprising:

reading, with a first encoder sensor of a first encoder, a first encoder scale thereof placed along a traveling direction of a carriage having a recording head configured to eject liquid droplets mounted thereon;

reading, with a second encoder sensor of a second encoder, a second encoder scale thereof placed along a traveling direction of an antiphase member configured to travel in opposite phase from the carriage;

controlling a travel of the carriage in accordance with a detection result of the first encoder based on said reading the first encoder scale and a detection result of the second encoder based on said reading the second encoder scale;

counting a first detection pulse and a second detection pulse, said first detection pulse being from said first encoder and obtained at an acceleration and deceleration region of said carriage, and said second detection pulse being from said second encoder and obtained at a uniform-speed region of said carriage; and switching from using one of said first encoder and said second encoder to using the other of said first encoder and said second encoder.

12. The non-transitory computer-readable storage medium as claimed in claim 11, wherein the antiphase member is a vibration damping member configured to prevent a vibration from being caused by an acceleration or deceleration of the carriage.

13. The non-transitory computer-readable storage medium as claimed in claim 11, wherein said controlling includes:

controlling the travel of the carriage in accordance with the detection result of the first encoder in the acceleration and deceleration region of the carriage; and controlling the travel of the carriage in accordance with the detection result of the second encoder in the uniform-speed region of the carriage.

14. The non-transitory computer-readable storage medium as claimed in claim 11, wherein said controlling includes:

determining a contaminated region of the first encoder by comparing the detection result of the first encoder and the detection result of the second encoder; and controlling the travel of the carriage in accordance with the detection result of the second encoder in the contaminated region of the first encoder.

15. The non-transitory computer-readable storage medium as claimed in claim 11, wherein said controlling includes:

determining a presence or absence of a contaminated region of the first encoder by comparing the detection result of the first encoder and the detection result of the second encoder; and controlling the travel of the carriage in accordance with only the detection result of the first encoder in response to determining the absence of the contaminated region of the first encoder.

* * * * *